United States Patent [19]

Farber et al.

[11] Patent Number: 4,496,080

[45] Date of Patent: Jan. 29, 1985

[54] AUTOMATIC HOUSEHOLD BEVERAGE DISPENSER

[75] Inventors: Karlheinz Farber; Hartmann Nelzow, both of Giengen, Fed. Rep. of Germany

[73] Assignee: Bosch-Siemens Hausgeraete GmbH, Stuttgart, Fed. Rep. of Germany

[21] Appl. No.: 517,928

[22] Filed: Jul. 28, 1983

Related U.S. Application Data

[63] Continuation of Ser. No. 468,804, Feb. 28, 1983, abandoned.

[30] Foreign Application Priority Data

Oct. 30, 1979 [DE] Fed. Rep. of Germany ... 7930729[U]

[51] Int. Cl.[3] ..... B67D 5/56

[52] U.S. Cl. ..... 222/129.3; 222/183

[58] Field of Search ..... 222/129.1, 129.2, 129.3, 222/129.4, 146 C, 182, 183, 146 R; 194/13, 1; 251/137, 141

[56] References Cited

U.S. PATENT DOCUMENTS

| | | | |
|---|---|---|---|
| 2,583,461 | 1/1952 | Arnett | 222/129.3 X |
| 2,657,628 | 11/1953 | Von Stoeser | 194/13 |
| 2,828,889 | 4/1958 | Joschko | 222/129.4 X |
| 2,873,069 | 2/1959 | Matthews | 251/137 X |
| 3,159,190 | 12/1964 | Skiera et al. | 222/146 HE X |
| 3,195,779 | 7/1965 | Nicko | 222/131 X |
| 3,531,019 | 9/1970 | Rodgers | 222/146 HE |
| 4,310,023 | 1/1982 | Kah, Jr. | 251/141 X |

*Primary Examiner*—Stanley H. Tollberg

*Attorney, Agent, or Firm*—Herbert L. Lerner; Laurence A. Greenberg

[57] ABSTRACT

Automatic household beverage dispenser including an equipment cabinet having a front and defining a mixing space with a dispensing station and an equipment space formed therein, detachable and replaceable functional parts including supply tanks for beverage concentrate and a device for dispensing carbon dioxide, electrical and flow devices for proportionate dispensing of concentrate, forming a mixture of concentrate and water and conducting the mixture to the dispensing station, the equipment space having a coverable opening formed at the front of the equipment cabinet for removal and replacement of all of the functional parts.

6 Claims, 5 Drawing Figures

AUTOMATIC HOUSEHOLD BEVERAGE DISPENSER

This application is a continuation of application Ser. No. 468,804, filed Feb. 28, 1983 now abandoned.

The invention relates to an automatic household beverage dispenser with exchangeable supply tanks for beverage concentrates, a carbon dioxide tank or the like, as well as electrical and flow devices for the proportionate discharge of concentrate, mixing with water and conduction of the mixture to a dispensing station.

While such known automatic beverage dispensers are operable from the front of the equipment, as far as switching-on the equipment, the selection of the beverage and the dispensing of the chosen beverage is concerned, replacement of the supply tanks, exchanging the empty carbon dioxide bottle and the like are not directly possible exclusively from the front of the equipment in these known automatic beverage dispensers. As a consequence, such automatic beverage dispensers cannot be used as so-called built-in appliances, in which at least the major part of the lateral surfaces of the equipment are enclosed by furniture, for instance by built-in kitchen furniture such as under a counter. Although such automatic beverage dispensers have a capacity of approximately 1500 beverage portions, replenishing the automatic dispenser is nevertheless necessary from time to time. In the above-mentioned known automatic dispenser, if used as a built-in appliance, the entire equipment would then have to be removed from its built-in position every time, which the consumer cannot be expected to do.

It is accordingly an object of the present invention to provide an automatic household beverage dispenser which overcomes the hereinafore-mentioned disadvantages of the heretofore-known devices of this general type, and to do so in such a manner that it can be fully operated from the front and therefore its use as a built-in appliance becomes possible.

With the foregoing and other objects in view there is provided, in accordance with the invention, an automatic household beverage dispenser comprising an equipment cabinet having a front and defining a mixing space with a dispensing station and an equipment space formed therein, detachable and replaceable functional parts including supply tanks for beverage concentrate and means for dispensing carbon dioxide, electrical and flow means for proportionate dispensing of concentrate, forming a mixture of concentrate and water and conducting the mixture to the dispensing station, the equipment space having a coverable opening formed at the front of the equipment cabinet for removal and replacement of all of the functional parts.

In accordance with another feature of the invention, the equipment space is located above the mixing space, and there is provided a detachable or hinged cover or aperture disposed over the opening.

In accordance with a further feature of the invention, the equipment space formed in the equipment cabinet is subdivided into chambers for each of the functional parts, the chambers being open toward the opening.

In accordance with an added feature of the invention, starting from the boundary of the cabinet the equipment space formed in the equipment cabinet is subdivided into one space at the front of the equipment cabinet being open toward the opening for the supply tanks and carbon dioxide dispensing means, and at least one other space being disposed behind the one space and open toward the opening for functional parts requiring routine servicing such as a water filter.

In the known automatic beverage dispensers of the above-mentioned type, each of the replaceable supply tanks for the beverage concentrate, from which the individual concentrate portions are taken, is provided for dispensing with a dosing valve which is opened electromagnetically for discharging a portion. To provide an operating device, each supply tank is assigned a toroidal coil which is disposed in fixed relationship to the equipment and into which the supply tank must be set with its dosing valve, from the top. The dosing valve is opened by energizing the toroidal coil.

In accordance with an additional feature of the invention, full operability from the front with very small overall equipment height is made possible by providing at least one dosing valve connected to at least one of the supply tanks, and electromagnetic means being fixed in the equipment cabinet for actuating the at least one dosing valve and including a U-shaped magnetic yoke being open toward the front of the equipment cabinet and a magnetic coil mounted on the yoke.

In accordance with yet another feature of the invention, the U-shaped magnet yoke has legs, and there are provided protective walls surrounding the legs toward the front of the equipment cabinet, the walls having a niche formed therein for receiving the supply tank and dosing valve.

In accordance with a concomitant feature of the invention, there are provided means, preferably a bank of push buttons disposed at the boundary of the front of the equipment cabinet in vertical alignment with the dispensing station for indicating beverage selection and for operating the functional parts and electrical and flow means. Through the embodiment according to the innovation, not only is optimum operability from the front obtained, but the costs for the operating device are also lowered over known constructions due to the substantially reduced copper content.

Other features which are considered as characteristic for the invention are set forth in the appended claims.

Although the invention is illustrated and described herein as embodied in an automatic household beverage dispenser, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
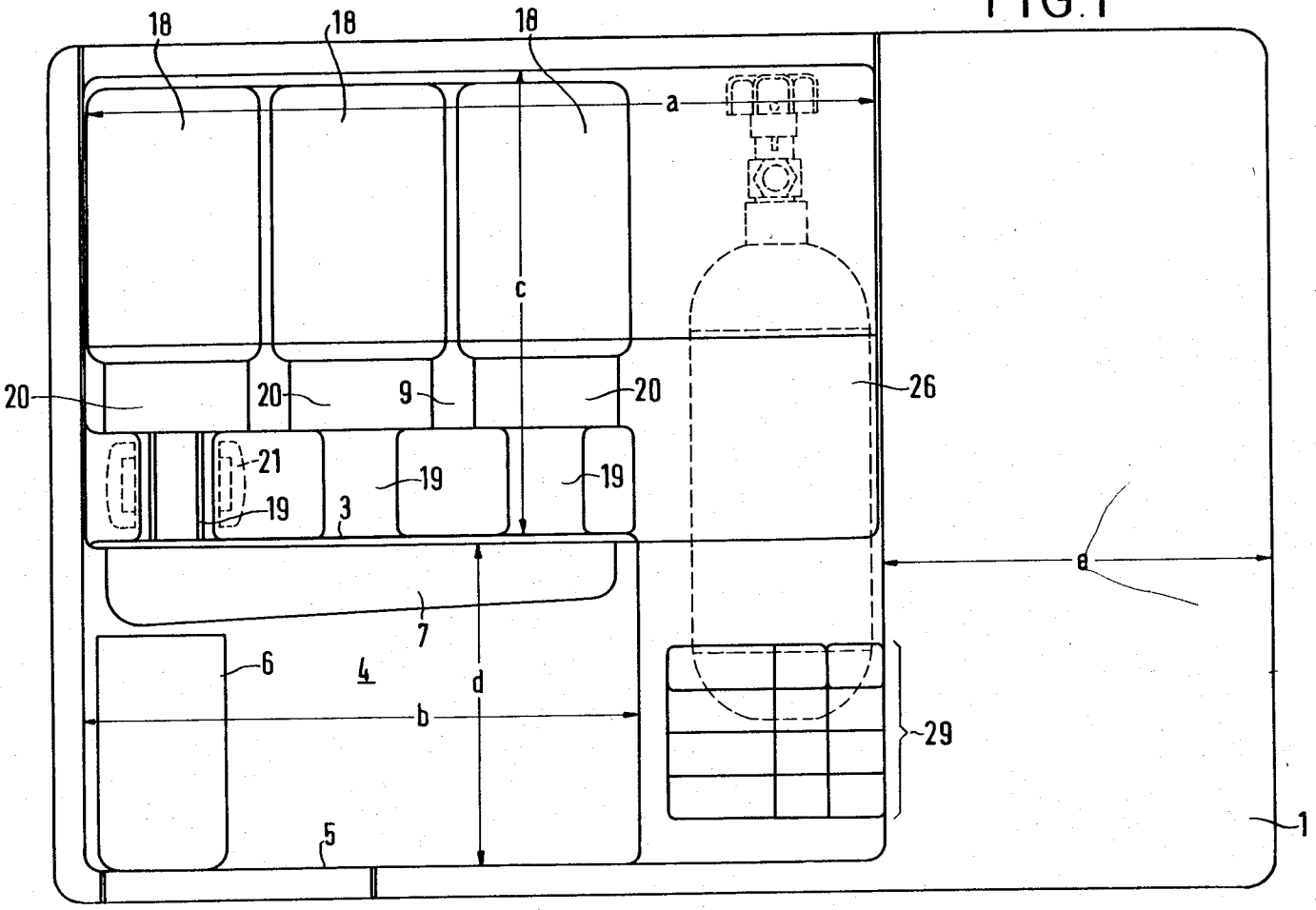
FIG. 1 is a diagrammatic front elevational view of the automatic household beverage dispenser according to the invention.
Figure 2:
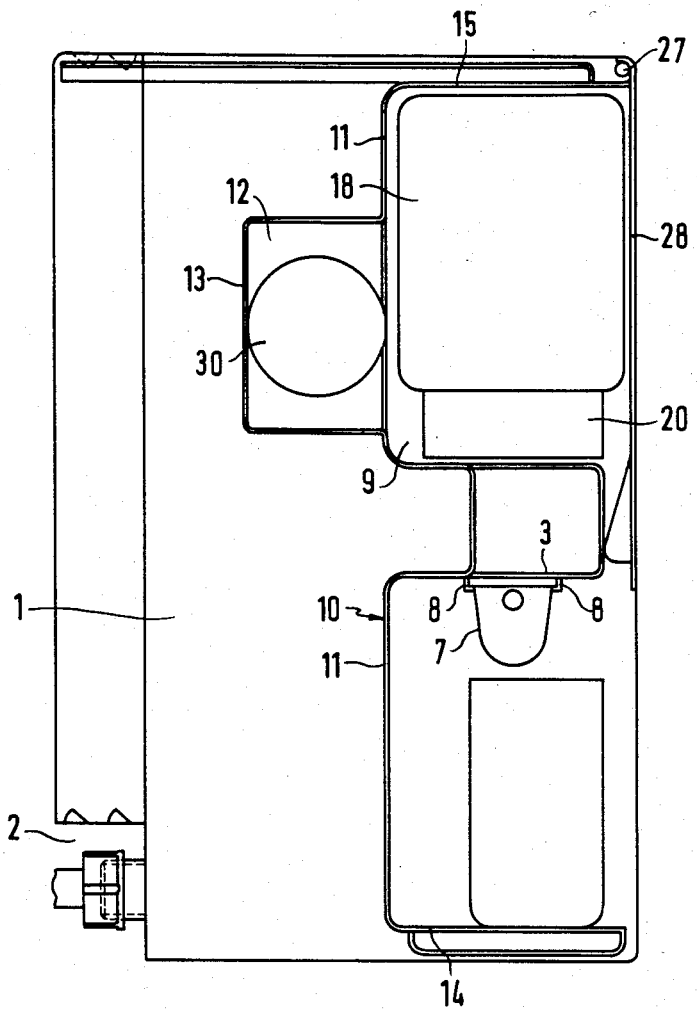
FIGS. 2 and 3 are two different cross-sectional side views of the automatic dispenser according to FIG. 1.
Figure 3:
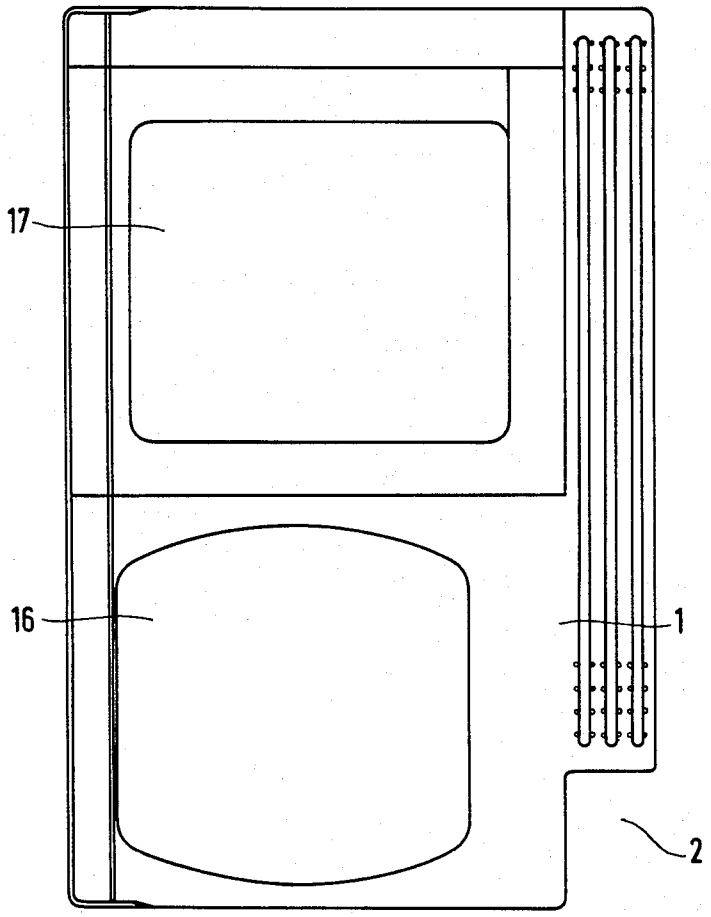

Referring now to the figures of the drawing and first particularly to FIGS. 1–4 thereof, it is seen that the automatic household beverage dispenser has a box-like equipment cabinet 1, formed of plastic material for example; the front of the equipment thereof being shown in FIG. 1. At the rear of the equipment, the equipment cabinet 1 is provided with a lower recess 2, in the area of which electrical connections or water connections that are not further shown may be located. As shown in FIG. 1 in conjunction with FIG. 4, the front of the equipment in the region of the widths a and b is open toward the front of the equipment and is divided in height by an intermediate bottom 3 into two spaces disposed on top of each other having heights c and d, respectively. The lower space in FIG. 1 having the width b and the height d forms a dispensing space 4, on the bottom 5 of which a drinking glass 6 is placed at a dispensing area. A beverage mixing channel 7 with an inclined bottom is detachably fastened to the lower surface of the intermediate bottom in guide strips 8, as shown in FIG. 1 in conjunction with FIG. 2. The upper equipment space 9 of width a and depth c as well as the lower space 4 are separated from the rest of the interior of the equipment by a tray-like shell body 10. The shell body 10 has a back wall 11, which is formed at about half the height thereof, forms the intermediate bottom 3, and has a recess 13 in the region of the upper space which forms a further space 12 that is accessible from the front. The shell body 10 further has horizontal shell walls 14 and 15. Corresponding to the spaces 4 and 9, the shell body 10 has stepped widths a and b as well as a height which results from adding up the partial heights c and d. As indicated in FIG. 3, in the area of the equipment space having a width e indicated in FIG. 1, there are provided a compressor 16 of a refrigeration device of a type which is known per se as well as a corbonizer or carbonater 17, that is also known per se, on top of each other. In the embodiment example, three beverage concentrate supply tanks 18 which have dosing valves 19 on the bottom thereof can be placed vertically in the space 9. The supply tanks 18 are supported with step-like extensions 20 on the upper boundary of the recess of the shell body 10 disposed at medium height as shown in FIG. 2. The mixing channel 7 is open toward the top, i.e. toward the dosing valves 19. As is shown in FIG. 1 in conjunction with FIG. 4, each supply tank 18 is assigned an electromagnetically operable actuating device at a height of the dosing valves. Each actuating device includes a substantially U-shaped magnetic yoke 21 and a magnetic coil 22 disposed thereon. As may be seen particularly from FIG. 4, the free legs of the U-shaped magnetic yoke 21 are surrounded by protective walls 23 of an insulating strip 24, which can be part of the shell body 10. The protective walls form niches 25 open toward the front, into which the supply tanks 18 with their dosing valves 19 can be placed horizontally, from the front of the equipment.

A carbon dioxide tank 26 can be placed laterally next to the supply tanks 18 into the upper space 9 within the shell body 10, and can be connected to corresponding gas lines.

Figure 4:
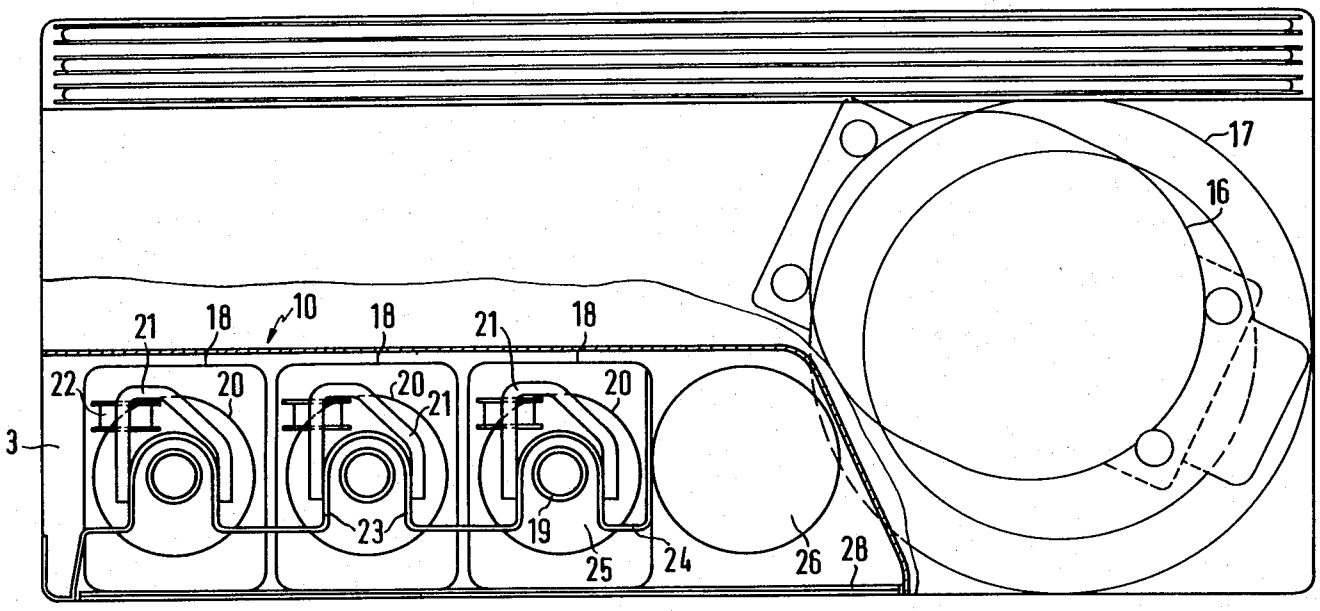
FIG. 4 is a longitudinal sectional view, partly broken away, of the automatic household beverage dispenser according to the preceding figures, shown from the top.

As can be seen from FIGS. 2 and 4, the cutout of the equipment cabinet 1 which is open toward the front can be covered in the area of the upper space 9 by a front shield 28 which can be hinged, for instance, upward about the fulcrum at 27, and may be transparent or provided on the outer surface thereof with appropriate reference notes as to the content of the supply tanks 18.

Finally, on the front of the equipment at the height of the mixing and dispensing station, i.e. of the lower space 4, there are disposed operating and indicating devices or organs 29 in the form of a bank of pushbuttons. Each of the four pushbuttons which are disposed one below the other in the embodiment example, is assigned to one of the supply tanks 18 which contain different syrups; the fourth pushbutton serving for making a plain soda beverage available. If a pushbutton which is assigned to one of the supply tanks is operated, carbonated water flows into the mixing channel 7 from a water tank which is provided with a cooling device but is otherwise not further shown. Shortly thereafter, the magnetic coil 22 of the actuating device is energized, whereby a predetermined amount of concentrate is dispensed into the mixing channel 7 from the dosing valve 19 of the supply tank 18; this concentrate is mixed there with the carbonated water and flows into the glass 6.

As the figures make clear, all functional parts of the automatic beverage dispenser which must be replaced from time to time (such as supply tanks 18 and carbon dioxide tank 26) or must be serviced, such as the water filter 30 that is accommodated in the recess 13, are accessible exclusively from the front of the equipment, so that the hereinafore-described equipment can be used to advantage as built-in equipment.

Figure 5:
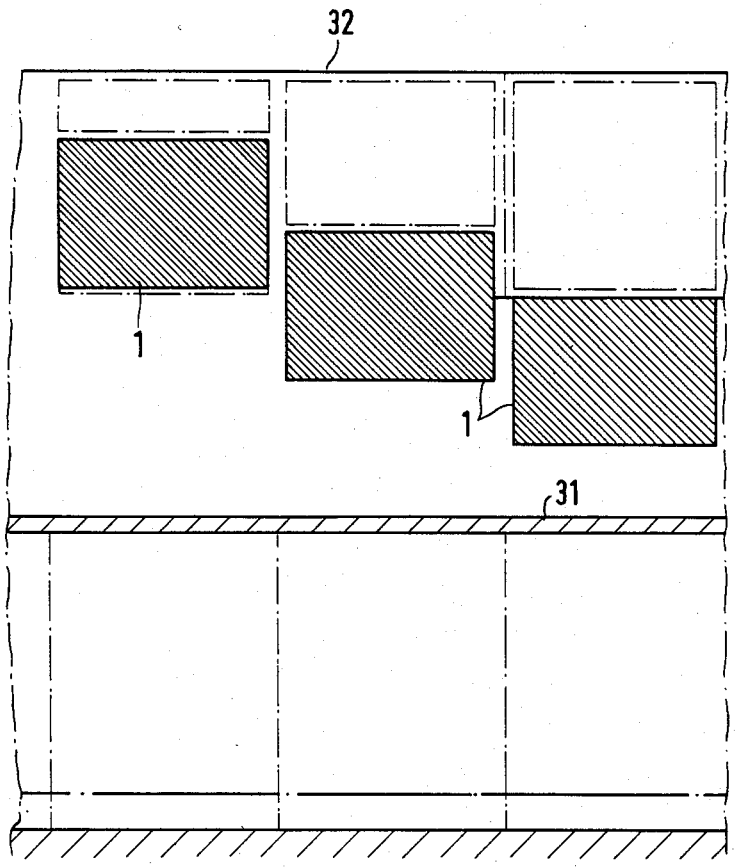
FIG. 5 is a fragmentary diagrammatic top plan view of a built-in kitchen block in conjunction with the automatic household beverage dispenser according to the innovation.

FIG. 5 shows some possibilities of building-in the automatic household beverage dispenser described herein. The equipment 1 is only indicated diagrammatically with outlines. Above a working surface 31, a cabinet line 32 is disposed at a distance from the working surface. FIG. 5 shows three different possibilities for building the automatic beverage dispenser onto or into this cabinet line. On the right in FIG. 5, the automatic beverage dispenser is mounted directly to the lower boundary of the cabinet line 32 at a distance from the working surface 31. In the variant example shown in the center of FIG. 5, the automatic beverage dispenser is built into the cabinet line 32 with its upper part only so that practically only the space 4, i.e. the mixing and dispensing station of the equipment as well as the operating and indicating organs 29 at the same height, still protrude underneath the cabinet line 32 and are freely accessible there at the working level. In the variant example at the left in FIG. 5, on the other hand, the entire automatic beverage dispenser is built into the cabinet line and can be covered by a cabinet door.

There are claimed:

1. Automatic household beverage dispenser, comprising an equipment cabinet having a front, a mixing chamber formed in said cabinet, an equipment chamber formed in said cabinet, a wall separating a portion of said equipment chamber from the remainder of said cabinet including said mixing chamber, said mixing chamber having a dispensing station disposed therein and said mixing chamber having electrical and flow means disposed therein separate from said wall for proportionate dispensing of concentrate, for forming a mixture of concentrate and water and for conducting the mixture to said dispensing station, said portion of said equipment chamber having detachable and replaceable functional parts disposed together therein including supply tanks for beverage concentrate and means for dispensing carbon dioxide, and said equipment chamber having a coverable opening formed at said front of said equipment cabinet for removal and replacement of all of said functional parts disposed therein, said equipment chamber formed in said equipment cabinet being subdivided into one chamber at said front of said equipment cabinet being open toward said opening for said supply tanks and carbon dioxide dispensing means, and at least one other chamber being disposed behind said one chamber and open toward said opening for functional parts requiring routine servicing.

2. Automatic household beverage dispenser according to claim 1, wherein said equipment chamber is located above said mixing chamber, and including a hinged cover disposed over said opening.

3. Automatic household beverage dispenser according to claim 1, wherein said equipment chamber formed in said equipment cabinet is subdivided into chambers for each of said functional parts, said chambers being open toward said opening.

4. Automatic household beverage dispenser, comprising an equipment cabinet having a front, a mixing chamber formed in said cabinet, an equipment chamber formed in said cabinet, a wall separating a portion of said equipment chamber from the remainder of said cabinet including said mixing chamber, said mixing chamber having a dispensing station disposed therein and said mixing chamber having electrical and flow means disposed therein separate from said wall for proportionate dispensing of concentrate, for forming a mixture of concentrate and water and for conducting the mixture to said dispensing station, said portion of said equipment chamber having detachable and replaceable functional parts disposed together therein including supply tanks for beverage concentrate and means for dispensing carbon dioxide, and said equipment chamber having a coverable opening formed at said front of said equipment cabinet for removal and replacement of all of said functional parts disposed therein, at least one dosing valve connected to at least one of said supply tanks, and electromagnetic means being fixed in said equipment cabinet for actuating said at least one dosing valve and including a U-shaped magnetic yoke being open toward said front of said equipment cabinet and a magnetic coil mounted on said yoke.

5. Automatic household beverage dispenser according to claim 4, wherein said U-shaped magnet yoke has legs, and including protective walls surrounding said legs toward said front of said equipment cabinet, said walls having a niche formed therein for receiving said supply tank and dosing valve.

6. Automatic household beverage dispenser according to claim 1, including mean disposed at said front of said equipment cabinet in vertical alignment with said dispensing station for indicating beverage selection and for operating said functional parts and electrical flow means.

* * * * *